US008456088B2

(12) United States Patent
Kling et al.

(10) Patent No.: US 8,456,088 B2
(45) Date of Patent: Jun. 4, 2013

(54) PAR LAMP

(75) Inventors: Michael R. Kling, Lexington, KY (US); Jeffrey P Buschmann, Lexington, KY (US)

(73) Assignee: OSRAM SYLVANIA Inc., Danvers, MA (US)

( * ) Notice: Subject to any disclaimer, the term of this patent is extended or adjusted under 35 U.S.C. 154(b) by 216 days.

(21) Appl. No.: 12/589,359

(22) Filed: Oct. 22, 2009

(65) Prior Publication Data

US 2011/0095681 A1 Apr. 28, 2011

(51) Int. Cl.
*H01J 5/46* (2006.01)
*H01J 5/50* (2006.01)

(52) U.S. Cl.
USPC ..... 313/623; 313/284; 313/285

(58) Field of Classification Search
USPC ..... 313/579, 623, 318.01, 284, 285, 313/318.12, 274; 362/548, 306, 439, 445; 439/605; 445/26, 27
See application file for complete search history.

(56) References Cited

U.S. PATENT DOCUMENTS

| | | | | |
|---|---|---|---|---|
| 3,323,855 | A | 6/1967 | Prijn | |
| 3,904,909 | A | 9/1975 | Vause | |
| 4,241,391 | A * | 12/1980 | Pitkjaan et al. | 362/548 |
| 4,608,624 | A * | 8/1986 | Blaisdell et al. | 362/659 |
| 5,660,462 | A | 8/1997 | Bockley | |
| 5,751,095 | A | 5/1998 | Zalar | |
| 2005/0212396 | A1 | 9/2005 | Oetken | |
| 2006/0043890 | A1 | 3/2006 | Kling | |
| 2009/0033219 | A1 | 2/2009 | Stark | |

FOREIGN PATENT DOCUMENTS

| | | |
|---|---|---|
| DE | 1489413 A1 | 3/1969 |
| EP | 1632987 A2 | 3/2006 |
| EP | 2020677 A2 | 2/2009 |
| JP | 61 11204 | 1/1986 |

* cited by examiner

*Primary Examiner* — Karabi Guharay
(74) *Attorney, Agent, or Firm* — Edward S. Podszus

(57) ABSTRACT

A light source capsule (16) having a capsule envelope (18) with a wall (20) defining an enclosed volume (22), and having a sealed portion (24). A light source (26) is positioned in the enclosed volume (22) and has deformable electrical leads-ins (28, 30) extending through the sealed portion (24) of the capsule envelope (18). Stiff lead-in engagers (32) are aligned with the sealed portion (24) of the capsule envelope (18) and are electrically coupled to the electrical leads (28, 30), the lead-in engagers being electrically conductive. The lead-in engagers are fitted through apertures in the base (14) of a lamp envelope (12) to complete a lamp (10).

19 Claims, 5 Drawing Sheets

PAR LAMP

TECHNICAL FIELD

This invention relates to electric lamps and more particularly to reflector lamps. While the invention has applicability to lamps generally, including arc discharge lamps, it has specific application to tungsten halogen (T-H) parabolic reflector lamps (PAR lamps).

BACKGROUND ART

In tungsten-halogen lamps, the deposition of evaporated tungsten deposits on the envelope wall is reduced or retarded by the regenerative action of the halogen cycle, which operates by virtue of the temperature gradient between the filament and the bulb. As a general concept:

a. The filament, fill gas, and bulb are initially at some low temperature (e.g., ambient, for a cold start).
b. When power is applied, the filament rapidly rises to its operating temperature (2800K to 3400K depending on application), heating the fill gas and the bulb. The bulb wall rises to an operating temperature of 400° C. to 1000° C., and the fill gas rises to temperatures ranging from that at the filament to that at the bulb wall. This temperature gradient causes convection currents in the fill gas.
c. As the bulb wall rises above temperatures in the range 200° C. to 250° C. (depending on nature and amount of halogen vapor), the halogen cycle begins to operate. Tungsten molecules evaporated from the filament combine with the halogen vapor to form a tungsten halide (e.g., tungsten iodide or tungsten bromide). The halide does not condense on the hot wall of the bulb but is circulated by convection back to the region of the filament.
d. At the filament where the temperature exceeds 2500° C., the tungsten halide dissociates, the tungsten is deposited on the filament, and
e. The free halogen vapor is recirculated to continue the regenerative cycle. This cycle thus keeps the bulb wall clean by preventing deposition of tungsten and results in much higher lumen maintenance over the life of the lamp than that obtained for conventional tungsten-filament lamps.

PAR lamps typically comprise a light source such, for example, as a tungsten halogen capsule comprised of quartz or a hard glass, mounted in a pressed borosilicate glass body having a reflective coating applied to the inner surface of the body. A pressed glass lens usually covers the front aperture of the body and may contain optical elements to give a desired beam shape, for example, a spot or flood configuration. General service PAR lamps typically have a medium screw base attached to the body for electrical connection to 100V to 240V circuits. In many T-H PAR lamps the hard glass capsule contains stiff electrical lead-ins that connect to the relatively deformable inner leads of the light source and that are themselves pressed into the seal area of the capsule. Such capsules are shown in U.S. Pat. No. 5,660,462, Bockley, et al., and U.S. Published Patent Applications 2005/0212396 A1, Oetken, et al. and 2006/0043890 A1, Kling (all of which are assigned to the assignee of the instant invention). Often, in such lamps the capsule is supported by crimping the leads into metal eyelets that are formed in the base of the envelope body.

Problems arise in the sealing of the heavy metal lead-ins into the glass. The differences in thermal expansion of the heavy metal lead-ins and the glass eventually causes cracking problems that shorten the life of the lamps. While numerous metal alloys have been developed to attempt to match, within a critical range, the thermal expansion of the glass, these alloys themselves are expensive and, sometimes, difficult to work with.

Another technique that has been employed utilizes additional parts such as a metal disc that fastens to the capsule and centers it in the neck of the envelope body. Such a technique is shown in U.S. Pat. No. 5,751,095, Zalar, which also employs multiple glass or ceramic insulators to guide the lead-ins to the screw base.

It would be an advance in the art to provide a simple and inexpensive way to mount a single ended hard glass capsule with deformable, flexible lead-ins into a hard glass reflector.

SUMMARY OF INVENTION

It is, therefore, an object of the invention to obviate the disadvantages of the prior art.

It is another object of the invention to enhance electric lamps.

Yet another object of the invention is the improvement of electric lamps, in particular, T-H lamps.

These objects are accomplished, in one aspect of the invention, by the provision of a light source capsule having a capsule envelope with a wall defining an enclosed volume, and having a sealed portion. A light source, such for example, as an incandescent filament operating on the above-described halogen cycle, is positioned in the enclosed volume and has deformable electrical leads-ins extending through the sealed portion of the capsule envelope. Stiff lead-in engagers are aligned with and overly the sealed portion of the capsule envelope and are electrically coupled, as by welding, to the electrical leads. The stiff lead-in engagers are electrically conductive.

In another aspect of the invention, the objects are accomplished by providing a lamp that contains a light source capsule as described above.

The stiff lead-in engagers eliminate the previous problems encountered with the prior art lamp capsules and provide a simple and economical expedient for mounting hard glass or quartz capsule with deformable leads into a hard glass reflector.

BRIEF DESCRIPTION OF THE DRAWINGS

FIG. 8 is a front elevation view, in section, of the alternate embodiment inserted into a lamp.

PREFERRED EMBODIMENT AND BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
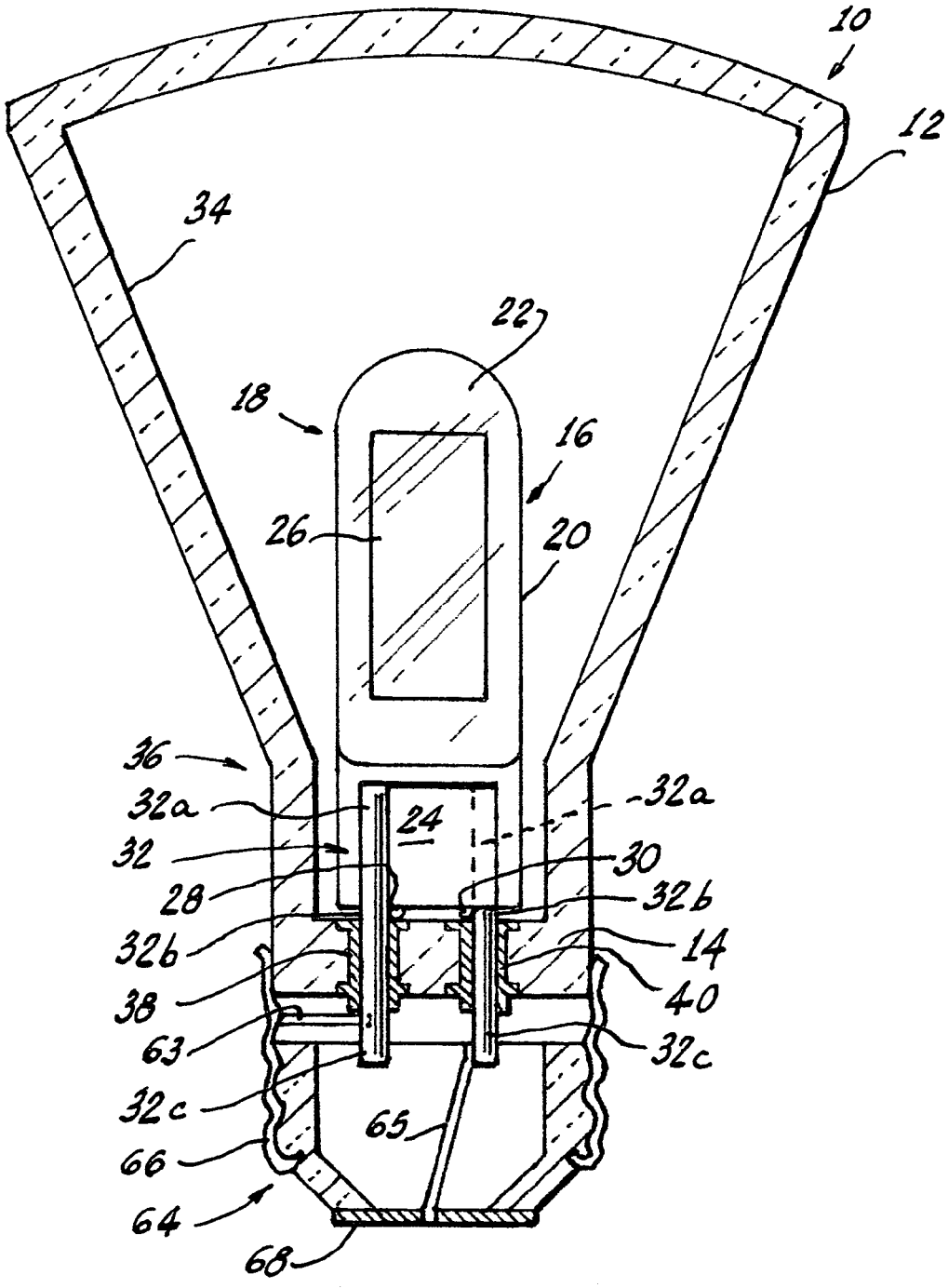
FIG. 1 is an elevation view, partially in section, of a lamp illustrating an embodiment of the invention.

Referring now to the drawings with greater particularity, there is shown in FIG. 1 a lamp 10 comprising a lamp envelope 12 with a base 14. The lamp envelope 12 is preferably formed from a borosilicate glass. A light source capsule 16 having a capsule envelope 18 with a wall 20 defining an enclosed volume 22, and having a sealed portion 24 is mounted within the lamp envelope 12. The capsule envelope 18 is formed from a hard glass or quartz.

A light source 26 is positioned within the enclosed volume 22 and has deformable electrical leads-ins 28, 30 extending through the sealed portion 24 of the capsule envelope 18 and exiting from end 51 of the sealed portion 24. The electrical lead-ins 28, 30 are formed of molybdenum wire having a diameter of 0.5 mm and are quite easily distorted during normal handling. Further, by themselves, they are not capable of supporting the weight of the light source capsule 16. A reflector coating 34, for example, aluminum, is applied to the interior surface of the envelope 12. Molybdenum (moly) foils 42, 44, are sealed within the seal 24 and also connect the inner ends 46, 48 of the deformable electrical lead-ins. The moly foils 42, 44 are most clearly illustrated in FIG. 2. While the light source 26 can be formed by an arc discharge, preferably it is an incandescent tungsten filament of the type known as a coiled coil that operates on the halogen cycle described above; that is, the environment within the enclosed volume 22 contains a suitable halogen, for example, iodine or bromine.

Figure 5:
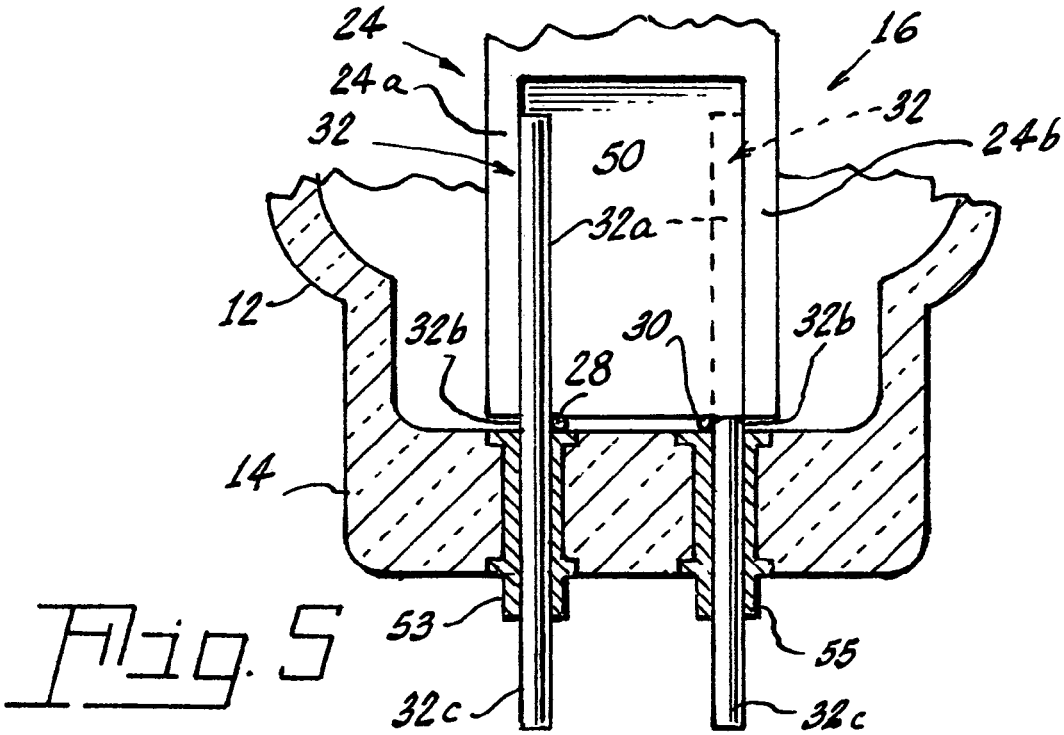
FIG. 5 is a partial, sectional, elevation view of the embodiment of FIGS. 3 and 4 inserted into a lamp.
Figure 6:
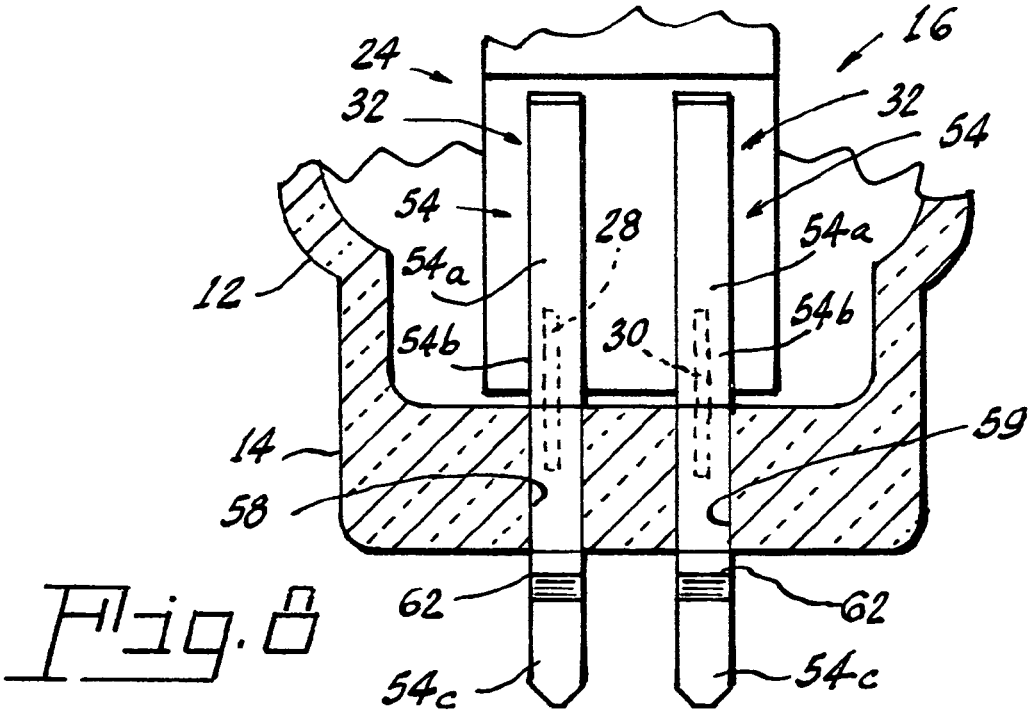
Figure 7:
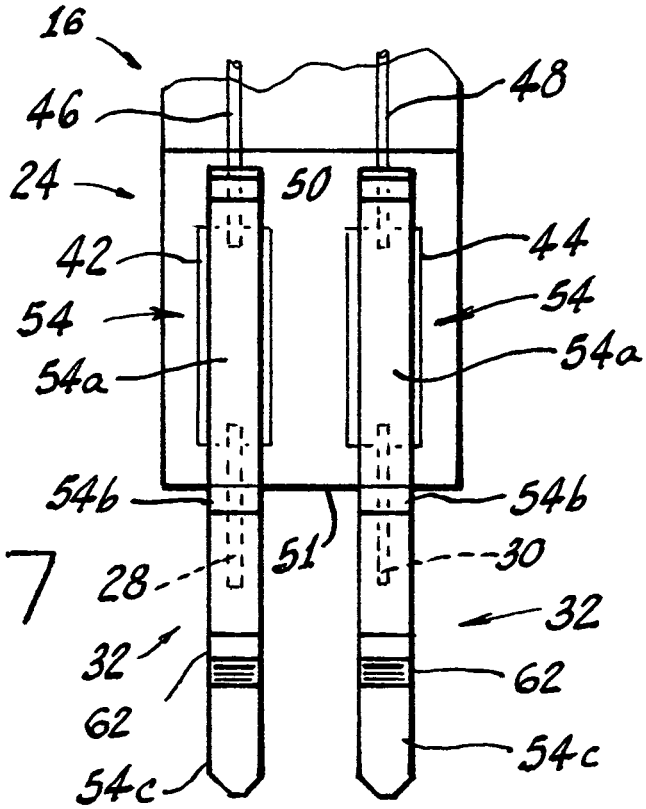
FIG. 7 is a front elevation of the alternate embodiment.
Figure 9:
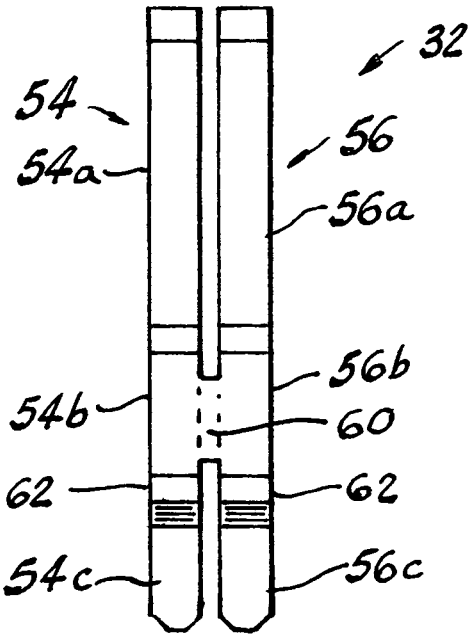
FIG. 9 is a front elevation view of the alternate embodiment after stamping and before bending to its final configuration.

Lead-in engagers 32 are aligned with and overlay the sealed portion 24 of the capsule envelope 18. In a preferred embodiment, one lead-in engager 32 lies on each side of the sealed portion 24, and is electrically coupled to the electrical leads 28, 30, for example, by welding. The lead-in engagers also are electrically conductive. The neck portion 36 of the lamp envelope 12 includes the base 14; and the base 14 includes receptacles 38, 40 formed to receive the two lead-in engagers 32. The receptacles 38, 40 as shown in FIG. 1 can take the form of eyelets or grommets 53, 55 as shown in FIG. 5 or apertures 58, 59 as shown in FIG. 8. The lead-in engagers are preferably stiff, that is, sufficiently rigid to avoid distortion during material handling and insertion.

Figure 2:
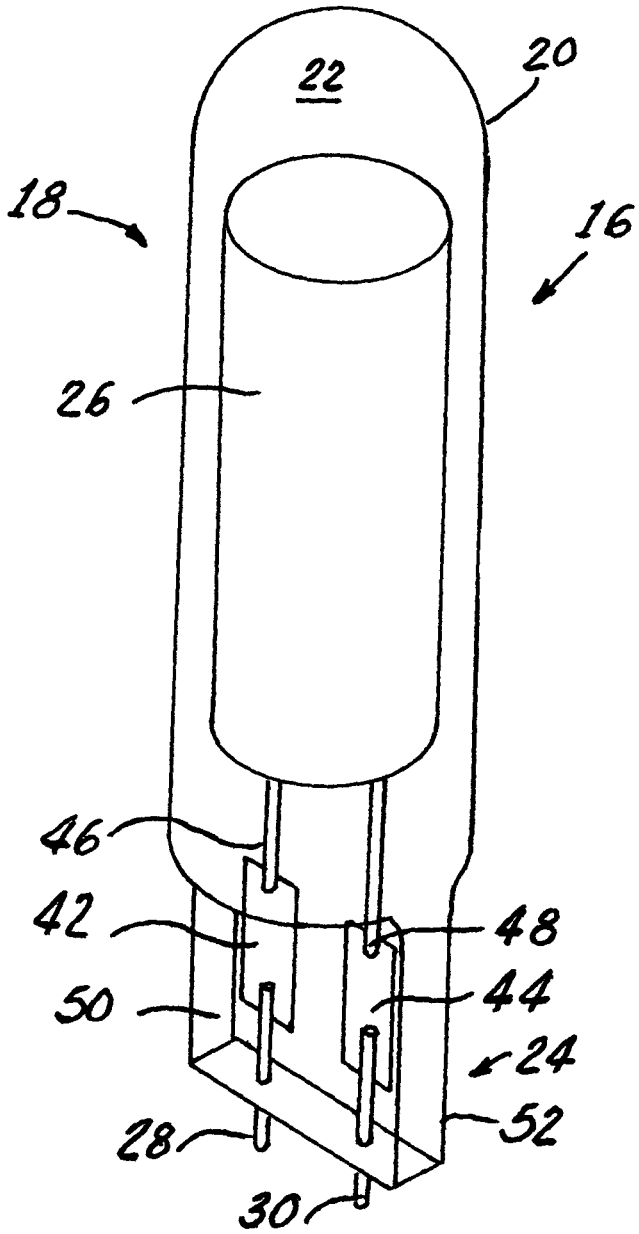
FIG. 2 is a perspective view of a light source capsule useable with the invention.
Figure 3:
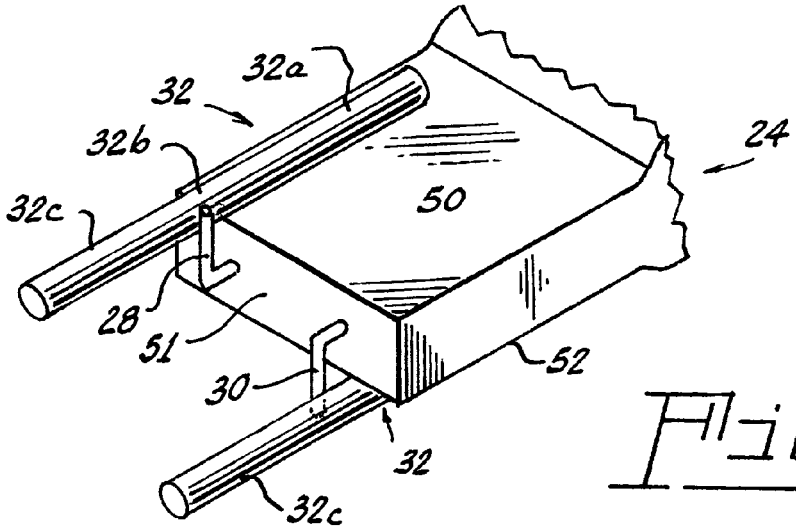
FIG. 3 is a perspective view of an embodiment of the invention.
Figure 4:
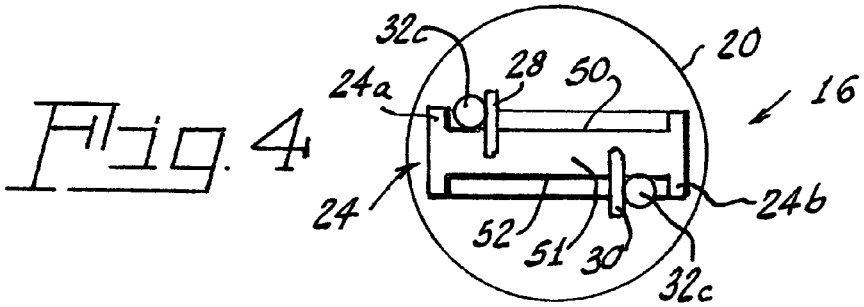
FIG. 4 is a plan view of the embodiment shown in FIG. 3.
Figure 6:
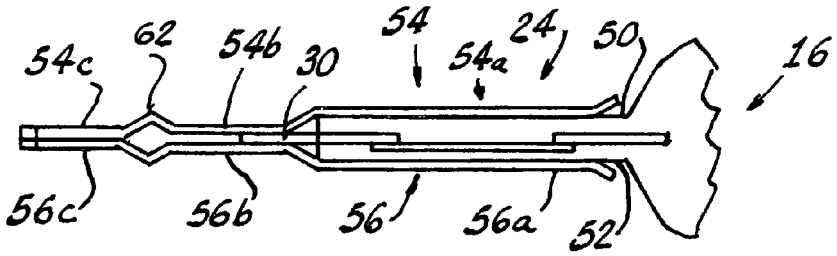
FIG. 6 is a side elevation view of an alternate embodiment of the invention.

The sealed portion 24 of the light source capsule 16 can take any of several configurations and as shown in FIGS. 2 and 3 presents two oppositely disposed planar surfaces 50, 52; and the lead-in engagers 32 each have a proximal portion 32*a*, a center portion 32*b* and a distal portion 32*c*, the proximal portions 32*a* of each of said lead-in engagers 32 lying along one of the planar surfaces 50, 52 of the sealed portion 24. As shown in FIGS. 4 and 5 the planar portions 50, 52 can lie between raised ribs 24*a*, 24*b*.

In the embodiment shown in FIGS. 1, 3, 4 and 5, the lead-in engagers 32 comprise rods, preferably cylindrical, having a minimum diameter of at least 1 mm and are constructed of any suitable material such for example, as stainless steel, nickel plated steel, or brass. The deformable lead-ins 28, 30 are bent about 90 degrees where they exit the end 51 of the sealed portion 24 and are welded to the distal portions 32*c* of the lead-in engagers 32.

To fix the light source capsule 16 into the lamp envelope 12 the distal portions 32*c* are fitted into grommets 53, 55 sealed into the base 14 where they can be staked or welded to fix the position. If desired, the grommets can be eliminated and the distal portions 32*c* fitted into cylindrical apertures formed in the press seal region, similar to the apertures 58, 59 shown in FIG. 8.

An alternate embodiment of the invention is shown in FIGS. 6-9. Therein, the lead-in engagers 32 are depicted as comprising spaced-apart parallel arms 54, 56. The arms 54, 56 comprise proximal portions 54*a*, 56*a*, intermediate portions 54*b*, 56*b*, and terminal portions 54*c*, 56*c*. The arms 54, 56 are connected at the intermediate portions 54*b*, 56*b* by a web 60. The proximal portions 54*a*, 56*a* are fitted over the planar surfaces 50, 52 of the sealed portion 24; for example, proximal portion 54*a* would be in contact with surface 50 while proximal portion 56*a* would be in contact with surface 52. The intermediate portions 54*b*, 56*b* contact the deformable electrical lead-ins 28, 30, preferably by sandwiching the electrical lead-ins between them. Fixation of the deformable lead-ins 28, 30 to the intermediate portions 54*b*, 56*b* is accomplished by welding or crimping; however, welding is preferred, since welding insures a better electrical connection. The terminal portions 54*c*, 56*c* are formed to engage apertures 58, 59 formed in said base 14.

Additionally, the terminal portions 54*c*, 56*c* can be provided with compressible spring locks 62. When the terminal portions 54*c*, 56*c* are inserted into the apertures 58, 59, the spring locks 62 will compress while passing through the apertures and then expand on the underside of the base 14, thus maintaining the entire capsule 16 in position without the necessity of any other elements.

In either of the embodiment disclosed herein, the lamp 10 is completed by adding a screw base 64 and making the appropriate electrical connections 63, 65 to side 66 of the screw and insulated bottom 68, respectively, to provide the electrical connections to the lead-in 28, 30.

There is thus provided a simple and economical mount for light source containing lamp capsules.

While there have been shown and described what are at present considered to be the preferred embodiments of the invention, it will be apparent to those skilled in the art that various changes and modifications can be made herein without departing from the scope of the invention as defined by the appended claims.

GLOSSARY OF REFERENCES NUMERALS EMPLOYED HEREIN

10 Lamp
12 Lamp envelope
14 Base of lamp envelope
16 Light source capsule
18 envelope of 16
20 wall of 18
22 volume of envelope 18
24 sealed portion of 16
  24*a* raised rib on 24
  24*b* raised rib on 24
26 light source within capsule 16 (i.e., filament or arc)
28 first deformable lead-in
30 second deformable lead-in
32 lead-in engager
  32*a* proximal portion of 32
  32*b* center portion of 32
  32*c* distal portion of 32
34 reflector coating
36 neck portion of lamp envelope 12
38 first receptacle formed in base 14
40 second receptacle formed in base 14
42 first molybdenum (moly) foil
44 second molybdenum foil
46 inner end of 28
48 inner end of 30

50 first planar surface of 24
51 end of 24
52 second planar surface of 24
53 first grommet in base 14
54 first parallel arm of 32
54*a* proximal portion of 54
54*b* intermediate portion of 54
54*c* terminal portion of 54
55 second grommet in base 14
56 second parallel arm of 32
56*a* proximal portion of 56
56*b* intermediate portion of 56
56*c* terminal portion of 56
58 aperture formed in base 14
59 aperture formed in base 14
60 web joining arms 54, 56
62 spring lock
63 screw base connection
64 screw base
65 eyelet connection
66 bottom of screw base

What is claimed is:

1. A light source capsule (16) having a capsule envelope (18) with a wall (20) defining an enclosed volume (22), and having a sealed portion (24), said sealed portion (24) having an end face (51) and opposing lateral faces (50, 52);

a light source (26) positioned in the enclosed volume (22) having electrical lead-ins (28, 30) extending from said end face (51); and lead-in engagers (32) overlying said sealed portion (24) of the capsule envelope (18) and electrically coupled to the electrical lead-ins (28, 30), each said lead-in engager (32) being formed, as seen in cross-section, of a solid rod, said solid rod comprising a straight rod portion, said straight solid rod portion having, in a region proximate said sealed portion (24), a uniform cross-sectional shape along a longitudinal extent of said lead-in engagers (32) whereby each said straight solid rod portion overlies only a single face (50, 51, 52) of said sealed portion (24).

2. The light source capsule (16) of claim 1 wherein said sealed portion (24) of said light source capsule (16) contains molybdenum foils (42, 44) connecting inner ends (46, 48) of said electrical lead-ins (28, 30).

3. The light source capsule (16) of claim 1 wherein said light source (26) is an incandescent light source.

4. The light source capsule (16) of claim 1 wherein said light source (26) is an arc discharge light source.

5. The light source capsule (16) of claim 1 wherein said electrical lead-ins (28, 30) are encapsulated in said sealed portion (24), exit through said end (51) and are bent at substantially 90 degrees.

6. A lamp (10) containing the light source capsule (16) of claim 1, said lamp (10) further comprising:

a lamp envelope (12) having a longitudinal axis (13), a base (14) substantially orthogonal to said longitudinal axis (13) and a neck (36) that includes said base (14), said base (14) having receptacles (38, 40) therein; one each of said lead-in engagers (32) being positioned, respectively, in one of said receptacles (38, 40).

7. The lamp (10) of claim 6 wherein said light source (26) is an incandescent light source.

8. The lamp (10) of claim 6 wherein said light source (26) is an arc discharge light source.

9. The lamp (10) of claim 6 wherein said electrical lead-ins (28, 30) are encapsulated in said sealed portion (24), exit through said end (51), and are bent at substantially 90 degrees.

10. The light source capsule (16) of claim 1 wherein each lead-in engager contacts only one side of the capsule, the lead-in engagers contacting opposite sides of the capsule, whereby the lead-in engagers supportingly sandwich the capsule (16).

11. The light source capsule (16) of claim 1 wherein said lead-in engagers (32) consist essentially of rods, said rods having the uniform cross-sectional shape across an entirety of their said longitudinal extent.

12. The light source capsule (16) of claim 1 wherein said lead-in engagers (32, 32), as seen in a projection perpendicular to the longitudinal extent of the lead-in engagers (32, 32), are located entirely within a lateral area bounded by a projection of the sealed portion (24) in a direction parallel the longitudinal extent of the lead-in engagers (32, 32).

13. The light source capsule (16) of claim 1 wherein each said lead-in engager further comprises a compressible spring lock adapted to position said light source capsule (16).

14. A light source capsule (16) having a capsule envelope (18) with a wall (20) defining an enclosed volume (22), and having a sealed portion (24), said sealed portion (24) having an end (51);

a light source (26) positioned in the enclosed volume (22) having electrical lead-ins (28, 30) extending from said end (51); and lead-in engagers (32) overlying said sealed portion (24) of the capsule envelope (18) and electrically coupled to the electrical lead-ins (28, 30), wherein each said lead-in engager (32) comprises a pair of spaced-apart parallel arms (54, 56), said arms (54, 56) comprising proximal portions (54*a*, 56*a*), intermediate portions (54*b*, 56*b*), and terminal portions (54*c*, 56*c*), said proximal portions (54*a*, 56*a*) of each said lead-in engager (32) overlying said sealed portion (24), each said pair of intermediate portions (54*b*, 56*b*) of a respective said lead-in engager (32) being in electrical contact with a respective one of said electrical lead-ins (28, 30), and said terminal portions (54*c*, 56*c*) being formed to engage apertures (58.59) formed in a base (14) of a lamp envelope (12).

15. The light source capsule (16) of claim 14 wherein said parallel arms (54, 56) of said respective lead-in engagers (32) are connected at said intermediate portions (54*b*, 56*b*) by a web (60).

16. A lamp (10) containing the light source capsule (16) of claim 14, said lamp (10) further comprising:

a lamp envelope (12) having a longitudinal axis (13), a base (14) substantially orthogonal to said longitudinal axis (13) and a neck (36) that includes said base (14), said base (14) having receptacles (38, 40) therein; one each of said lead-in engagers (32) being positioned, respectively, in one of said receptacles (38, 40).

17. The lamp (10) of claim 16 wherein said parallel arms (54, 56) of said respective lead-in engagers (32) are connected at said intermediate portions (54*b*, 56*b*) by a web (60).

18. The light source capsule (16) of claim 14, wherein said proximal portions (54*a*, 56*a*) of each said lead-in engager (32) are overlying two opposed outwardly directed surfaces of said sealed portion (24).

19. A light source capsule (16) having a capsule envelope (18) with a wall (20) defining an enclosed volume (22), and having a sealed portion (24), said sealed portion (24) having an end face (51) and opposing lateral faces (50, 52);

a light source (26) positioned in the enclosed volume (22) having electrical lead-ins (28, 30) extending from said end face (51); and lead-in engagers (32) overlying said sealed portion (24) of the capsule envelope (18) and electrically coupled to the electrical lead-ins (28, 30), wherein said lead-in engagers (32) comprise rods, and each lead-in engager (32) contacts only one said face of the capsule, the lead-in engager (32) collectively contacting said opposing lateral faces of the capsule, whereby the led-in engagers supportingly sandwich the capsule (16).

* * * * *